US006050112A

United States Patent [19]

Walker

[11] Patent Number: 6,050,112

[45] Date of Patent: Apr. 18, 2000

[54] APPARATUS AND METHOD FOR DETECTING A LIQUID LEVEL IN A SEALED STORAGE VESSEL

[75] Inventor: James M. Walker, Fond du Lac, Wis.

[73] Assignee: Alliance Laundry Systems LLC, Ripon, Wis.

[21] Appl. No.: 09/097,536

[22] Filed: Jun. 15, 1998

[51] Int. Cl.[7] ..... D06F 33/00

[52] U.S. Cl. ..... 68/12.21; 68/18 R; 68/18 C; 73/291

[58] Field of Search ..... 68/18 C, 18 R, 68/12.21; 73/291, 295; 134/113

[56] References Cited

U.S. PATENT DOCUMENTS

| | | | |
|---|---|---|---|
| 5,197,329 | 3/1993 | Grundy | 68/12.21 |
| 5,267,455 | 12/1993 | Dewees et al. | 68/18 R |
| 5,466,946 | 11/1995 | Kleinschmitt et al. | 73/291 |
| 5,505,219 | 4/1996 | Lansberry | 134/195 |
| 5,798,698 | 8/1998 | Politt et al. | 73/291 |
| 5,850,747 | 12/1998 | Roberts et al. | 68/18 R |
| 5,858,107 | 1/1999 | Chao et al. . | |
| 5,866,797 | 2/1999 | Swanson . | |

*Primary Examiner*—Frankie L. Stinson
*Attorney, Agent, or Firm*—Leydig, Voit & Mayer, Ltd.

[57] ABSTRACT

A dry-cleaning apparatus using liquid carbon dioxide ($CO_2$) as the cleaning fluid has a liquid level detector for providing a continuous reading of the liquid $CO_2$ level in a storage tank. The liquid level detector includes a first resistance temperature detector disposed in the gas above the liquid, a second resistance temperature detector immersed in the liquid, and a third resistance temperature detector with an elongated sensing section disposed in part in the gas above the liquid and in part in the liquid. Each of the three resistance temperature detectors are heated by a constant current. Voltage signals indicating the respective resistance values of the resistance temperature detectors are measured and processed by a controller to continuously determine and monitor the liquid level in the storage tank.

7 Claims, 3 Drawing Sheets

APPARATUS AND METHOD FOR DETECTING A LIQUID LEVEL IN A SEALED STORAGE VESSEL

FIELD OF THE INVENTION

The present invention relates generally to liquid level detection systems, and, more particularly, to a system for detecting the level of a liquid in a sealed tank under high pressure, such as pressurized vessels used in liquid $CO_2$ dry-cleaning systems.

BACKGROUND OF THE INVENTION

Known dry-cleaning processes consist of wash, rinse, and drying cycles with solvent recovery. Garments are loaded into a basket in a cleaning drum and immersed in a dry-cleaning fluid or solvent, which is pumped into the cleaning drum from a storage tank. Conventional dry-cleaning fluids include perchloroethylene (PCE), petroleum-based or Stoddard solvents, CFC-113, and 1,1,1-trichloroethane, all of which are generally aided by a detergent. The dry-cleaning solvent is used to dissolve soluble contaminants, such as oils, and to entrain and wash away insoluble contaminants, such as dirt.

The use of these conventional dry-cleaning solvents poses a number of health and safety risks. At least one of these solvents, PCE, is a suspected carcinogen. Moreover, halogenated solvents are known to be environmentally unfriendly. To avoid these problems associated with the conventional solvents, dry-cleaning systems which utilize dense phase fluids, such as liquid carbon dioxide ($CO_2$), as a cleaning fluid have been developed. A dry-cleaning apparatus and method employing liquid $CO_2$ as the dry-cleaning fluid is disclosed in U.S. Pat. No. 5,467,492 entitled "Dry-Cleaning Garments Using Liquid Carbon Dioxide Under Agitation As Cleaning Medium." A similar dry-cleaning apparatus is disclosed in U.S. Pat. No. 5,651,276.

The $CO_2$ liquid used in these dry-cleaning systems is typically stored in a storage tank and injected into the cleaning vessel during a cleaning operation. To maintain its liquid form, the $CO_2$ in the storage tank has to be maintained under high pressure. Accordingly, the storage tank must be sealed and constructed with a thick, heavy-walled, structure to withstand the elevated pressure. The sealed structure of the storage tank and the high pressure therein make it difficult to directly monitor the level of the $CO_2$ liquid in the tank.

It has been proposed to use an array of point sensors disposed in the storage tank to detect the liquid $CO_2$ level. The point sensor, which may be of any of various known types, such as a temperature sensor or photo-conductivity sensor, provides a signal indicating whether the liquid level is up to the position of the sensor. Since such point sensors only sense discrete or specific levels of the liquid, they are not effective for monitoring continuous variations of the liquid level. Although improved liquid level monitoring can be achieved by providing a greater number of point sensors in the tank, such approach has the inherent disadvantage of increasing the cost of the dry-cleaning apparatus.

SUMMARY OF THE INVENTION

Accordingly, in view of the forgoing, it is an object of the present invention to provide a liquid level detection apparatus and method that can be used in a sealed and pressurized liquid storage vessel, such as the liquid $CO_2$ storage tank of a dry-cleaning system, to provide a continuous reading of the liquid level in the storage vessel.

Another object of the invention is to provide a liquid level detection apparatus as characterized above that minimizes the number of sensors that must be installed in the liquid storage vessel.

A further object of the invention is to provide a liquid level detection apparatus of the foregoing type that is easy to install and operate and provides more accurate monitoring of liquid levels.

These and other objects and advantages of the invention will be more readily apparent upon reading the following detailed description of a preferred exemplary embodiment of the invention and upon reference to the accompanying drawings in which:

Figure 1:
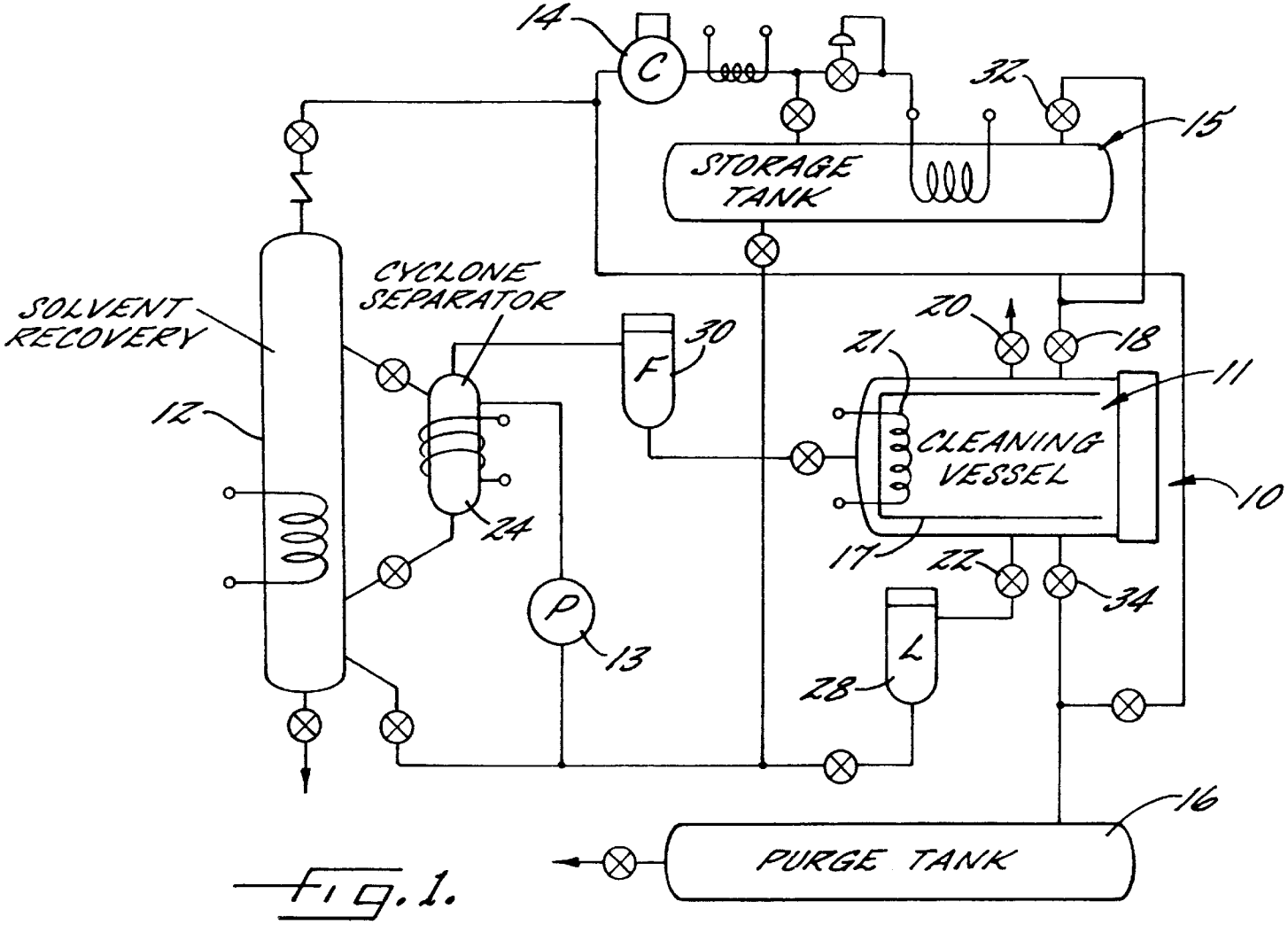
FIG. 1 is a schematic diagram of an illustrative dense phase liquid dry-cleaning apparatus having a sealed and pressurized liquid $CO_2$ storage tank with a liquid level detection apparatus according to the present invention.

While the invention is susceptible of various modifications and alternative constructions, a certain illustrated embodiment hereof has been shown in the drawings and will be described below. It should be understood, however, that there is no intention to limit the invention to the specific form disclosed, but, on the contrary, the invention is to cover all modifications, alternative constructions and equivalents falling within the spirit and scope of the invention as defined by the appended claims.

DETAILED DESCRIPTION OF THE PREFERRED EMBODIMENT

Turning now more particularly to FIG. 1 of the drawings, there is shown an illustrative dry-cleaning apparatus 10 which includes an associated liquid storage tank 15 with a liquid level detection apparatus in accordance with the present invention. The illustrated dry-cleaning apparatus 10 is of a type that utilizes liquid carbon dioxide ($CO_2$) as a dry-cleaning fluid or solvent, such as the dry-cleaning system disclosed in U.S. application Ser. No. 08/998,394, assigned to the same assignee as the present application, the disclosure of which is incorporated herein by reference. The dry-cleaning apparatus 10 basically includes a cleaning vessel 11, a solvent recovery device 12, a pump 13, a compressor 14, the liquid $CO_2$ storage tank 15, and a purge tank 16, all of which may be of a conventional type.

Figure 2:
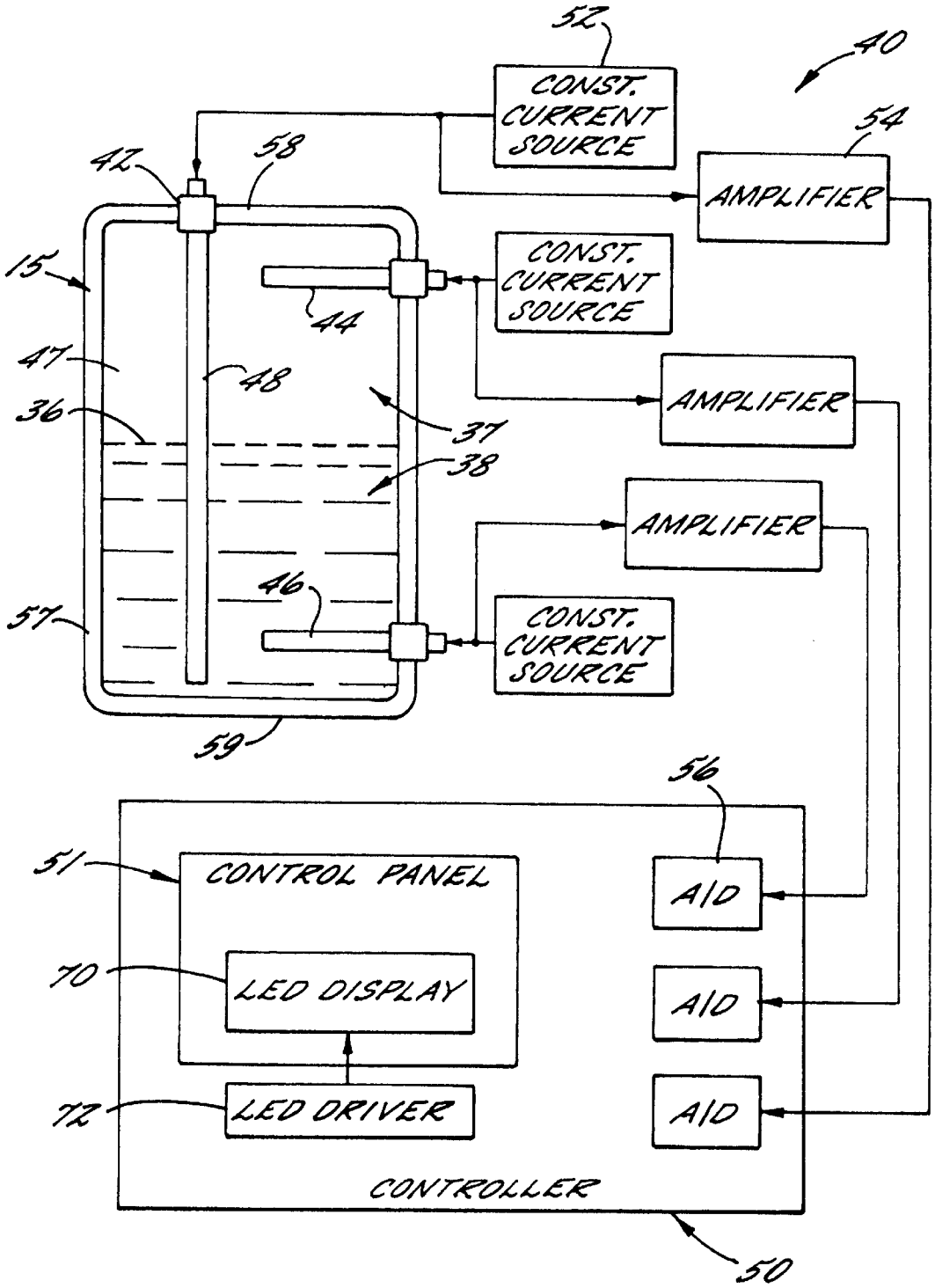
FIG. 2 is a schematic diagram of the liquid $CO_2$ storage tank and liquid level detection apparatus.

Briefly, the liquid $CO_2$ used in the dry-cleaning process is stored in the storage tank 15. Soiled garments or other items to be cleaned are deposited in a perforated rotatable basket 17 supported in the cleaning vessel 11. To begin the dry-cleaning process, the cleaning vessel 11 is charged with liquid $CO_2$ from the storage tank 15. After the wash and rinse cycles are completed, the now contaminated liquid $CO_2$ is drained from the cleaning vessel 11 to the solvent recovery device 12 which functions to vaporize the liquid $CO_2$to remove the contaminants. The vaporized $CO_2$ is then re-liquidized by a condenser (not shown) and returned to the storage tank 15. The pump 13 is used to transfer liquid $CO_2$between the components of the dry-cleaning apparatus, including the storage tank 15, the solvent recovery device 12, and the cleaning vessel 11. The compressor 14 is provided to pump gaseous $CO_2$ from the cleaning vessel 11 to a condenser (not shown) where it is condensed back into the liquid form and then returned to the storage tank 15. To control the pressure and temperature within the cleaning vessel 11, $CO_2$ may be quickly discharged from the cleaning vessel 11 to the purge tank 16. The cleaning operation is controlled and monitored by a controller 50 (FIG. 2) which has a control panel 51 for accepting user instructions and displaying information regarding various aspects of the dry-cleaning apparatus, including, for example, the level of liquid $CO_2$ in the storage tank 15.

Because $CO_2$ at a normal storage temperature and one atmospheric pressure is normally in the gas form, the $CO_2$ in the storage tank 15 has to be maintained under high pressure (e.g., 500–800 psi) to maintain it in the liquid form. Because of the high storage pressure, the storage tank has to be completely sealed and be constructed with a thick-walled heavy structure capable of withstanding the pressure. The sealed construction makes it more difficult to monitor the $CO_2$ liquid level in the storage tank. It is important, however, to accurately detect the continuously changing $CO_2$ liquid level in the storage tank to ensure the proper operation of the dry-cleaning apparatus. Conventional point sensors are inadequate because they only provide discrete liquid level readings and therefore cannot be used to continuously monitor the liquid level in the storage tank.

In accordance with the present invention, the sealed storage tank of the dry-cleaning apparatus is equipped with a liquid level detection apparatus for providing a continuous indication of the $CO_2$ liquid level in the storage tank. More particularly, the invention utilizes a plurality of sensors each adapted to provide a signal determined by heat dissipation rates within gaseous and/or liquid phases in the vessel, and a controller for processing the sensor signals to derive a continuous reading of the liquid level in the vessel. To that end, in the illustrated embodiment, a liquid level detection apparatus 40 is provided that includes three sensors 42, 44, and 46 which are mounted in a liquid-containing chamber 47 of the storage tank 15. The sensor 44 provides a gas-phase reference signal which is determined by a heat dissipation rate in the $CO_2$ gas above the $CO_2$ liquid in the storage tank. The sensor 46 provides a liquid-phase reference signal which is determined by a heat dissipation rate in the $CO_2$ liquid in the storage tank. The sensor 42, in contrast, provides an average signal which is determined by a combination of the gas-phase and liquid-phase dissipation rates depending on the liquid level in the storage tank. The signals from the three sensors are read by the controller 50 which determines the liquid level from the average signal in reference to the gas-phase and liquid-phase reference signals.

More particularly, to provide a signal for deriving a continuous reading of the liquid level, the averaging sensor 42 is provided with an elongated sensing section 48 which extends in part in the $CO_2$ gas 37 and in part in the liquid $CO_2$ 38 to generate an average signal which depends on the overall heat dissipation from the sensing section. Because the overall heat dissipation of the averaging sensor 42 is a continuous function of the length of the portion of the sensing section disposed in the liquid 38, the signal generated by the averaging sensor 42 provides a continuous indicator of the liquid level 36 in the storage tank 15.

For providing the reference signals for interpreting the average signal generated by the averaging sensor 42 to determine the liquid level, the gas-phase sensor 44 and the liquid-phase sensor 46 are respectively disposed entirely within the gas and liquid phases in the storage tank. The gas-phase sensor 44 is mounted in an upper portion of the tank in the $CO_2$ gas 37 above the $CO_2$ liquid 38. In contrast, the liquid-phase sensor 46 is mounted in a lower portion of the tank so as to be submerged in the liquid 38. Because the density of the $CO_2$ liquid is significantly higher than the density of the $CO_2$ gas in the tank, the liquid is more efficient in dissipating heat than the gas even though both the gas and liquid in the tank 15 are at the same equilibrium temperature. The different heat dissipation rates in the gas and in the liquid are reflected in the different signals generated by the gas-phase sensor 44 and liquid-phase sensor 46. Using the gas-phase and liquid-phase sensor signals as references, the controller 50 derives the liquid level 36 in the storage tank 15 from the signal of the averaging sensor 42.

In a preferred embodiment, the averaging, gas-phase, and liquid-phase sensors 42, 44, and 46 are resistance temperature detectors. The term "resistance temperature detector" (RTD) as used herein refers to a detector having a resistive sensing element with a temperaturedependent resistance. An RTD is commonly used for detecting the temperature of a fluid by measuring the variations of the resistance of the resistive sensing element in response to temperature changes in the fluid. It will be appreciated from the following description, however, that the RTDs in the illustrated apparatus are not used in the conventional way because their signals do not represent the temperature of the fluids they are disposed in.

Figure 3:
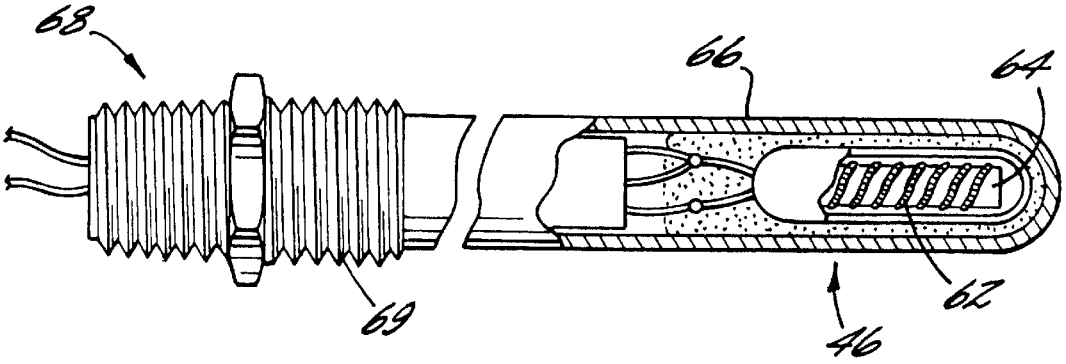
FIG. 3 is a schematic diagram of a resistance temperature detector (RTD) used in the illustrated liquid level detection apparatus.

The RTDs used as the sensors 42, 44, and 46 are similarly constructed. The illustrated RTD 46, for example, as shown in FIG. 3, has a resistive sensing element which is a thin metal wire 62 in a coiled or spiral form. The thin metal wire 62 is preferably formed of platinum. The resistive wire 62 is wound on a core 64 which is typically formed of ceramic. To prevent direct exposure of the sensing element to the environment in which the detector operates, the RTD 46 is enclosed in a housing or sheath 66 with a closed end. The sheath 66 preferably is made of stainless steel for its physical strength and chemical resistance. A signal output end 68 of the RTD 46 is preferably configured for sealed mounting on the storage tank 15. In the illustrated embodiment, the output end 68 of the RTD 46 includes a NPT fitting 69 for mating with a correspondingly threaded aperture on the wall of the tank. The length of the sensing section (i.e., the section in which the resistive sensing element extends) of an RTD is selected based on the purpose of the sensor. If the sensor is used to provide a signal indicating a thermal characteristic of a local region, as in the case of the gas-phase sensor 42 or the liquid-phase sensor 44, the sensing section may be made relatively short. On the other hand, if the sensor is used to provide a reading regarding a thermal characteristic averaged over a given length, as in the case of the averaging sensor 42, the sensing section is made to extend over that given length. RTDs are available, for example, from Minco Products, Inc. in Minneapolis, Minn.

To obtain a signal determined by the heat dissipation rate in the $CO_2$ gas 37 in the storage tank 15, the gas-phase sensor 44 in this case is mounted on a side wall 57 of the tank such that its sensing section extends horizontally in the $CO_2$ gas in the tank. Similarly, to obtain a signal determined by the heat dissipation rate in the $CO_2$ liquid in the tank, the illustrated liquid-phase sensor 46 is mounted on the side wall 57 with its sensing section extending horizontally in the $CO_2$ liquid in the tank. The mounting position of the gas-phase sensor 44 is preferably higher than the maximum liquid filling level of the tank 15 to ensure that the sensor is always surrounded by gaseous $CO_2$. To ensure that the liquid-phase sensor 46 is surrounded by the $CO_2$ liquid 38 at all times, the sensor is preferably mounted with its sensing section in close proximity to a bottom wall 59 of the tank.

In contrast, to obtain an average signal which depends on the liquid level 36 in the tank 15, the averaging sensor 42 is mounted in the tank such that its elongated sensing section 48 extends through both the gas 37 and the liquid 38. In a preferred embodiment, the elongated sensing section 48 is vertically oriented and has a length corresponding substantially to the height of the liquid-containing chamber 47 of the storage tank 15 defined by the bottom wall 59, side wall 57, and top wall 58. In this case, the sensor is mounted in depending relation from the top wall 58 of the vessel and has a length such that the lower end of the sensing section 48 is in close proximity to the bottom wall 59 of the vessel.

To generate sensor signals determined by the heat dissipation rates, a constant current generated by a constant current source 52 is passed through the resistive sensing element of each of the three sensors 42, 44, and 46. Due to the heat generated by the constant current, the resistive sensing element will be at a temperature higher than the ambient $CO_2$ (gas and liquid) temperature in the tank. The temperature of each resistant sensing element is determined by the rate at which heat is dissipated therefrom, which depends on whether the sensing section is in the gas or the liquid, or both. If the heat dissipation characteristics of the sensors are substantially identical, the resistive sensing element of the gas-phase sensor 44 will be at a higher temperature than that of the resistive sensing element of the liquid-phase sensor 46 due to the lower heat dissipation rate in the gas. The resistive sensing element of the averaging sensor 42, with its sensing section 48 extending through both the gas and the liquid, experiences both dissipation rates and as a result has different temperatures along its length.

For enabling the determination of the temperature of the sensing element of each sensor, the sensing element has known temperature dependence, which is typically provided as a temperature-resistance table. Once the resistance is measured, the temperature of the sensing element can be accurately determined. Due to its higher temperature, the resistive sensing element of the gas-phase sensor 44 exhibits a greater resistance change than that of the resistive sensing element of the liquid-phase sensor 46. Because the portion of the sensing element of the averaging sensor 42 in the liquid is at a lower temperature and the remaining portion in the gas is at a higher temperature, the overall resistance of the averaging sensor represents an averaged temperature of the sensing element which depends on where the liquid level 36 is located.

To facilitate a comparison of the resistance values of the sensors for determining the liquid level, the resistive sensing elements of the three sensors 42, 44, and 46 preferably all have substantially the same resistance value (e.g., 100 ohms) at a given reference temperature (e.g., 0° C.) and with substantially identical temperature dependence and heat dissipation characteristics. This allows the resistance values of the gas-phase sensor 44 and the liquid-phase sensor 46 to be used directly as references in the derivation of the liquid level from the resistance value of the averaging sensor 42. The same amount of constant current is used to heat the sensing element of each sensor. The magnitude of the constant current used depends on the power-handling capability of the sensing elements. For a platinum wire with a resistance of about 100 ohms used in the preferred embodiment, the current is typically about 0.1 ampere or less.

In order to detect the resistance value of the resistive sensing element of each of the sensors, the voltage drop across the resistive sensing element is measured. Because the current for heating the resistive element is held constant, the measured voltage is directly proportional to the resistance. In the illustrated embodiment, the voltage signals of the sensors are fed into respective amplifiers 54 for amplification, and the output signals of the amplifiers are connected to the controller 50 for determining the liquid level. For enabling the controller 50 to process the signals from the amplifiers 54, the signals from the amplifiers 54 are each converted into a digital number by an analog-to-digital (A/D) converter 56. The digital numbers, which represent the respective resistance values of the sensors, are then used by the controller 50 to calculate the liquid level. In the preferred embodiment in which the sensors have substantially the same nominal resistance, temperature dependence and thermal dissipation characteristics, the liquid level is calculated according to the following linear interpolation equation:

$$\text{liquid level}=L\,(R_{Average}-R_{Gas})/(R_{Liquid}-R_{Gas}),$$

where $R_{Gas}$, $R_{Liquid}$, and $R_{Average}$ are the digitized signals for the gas-phase sensor 44, liquid-phase sensor 46, and averaging sensor 42, respectively, and L is the length of the sensing section 48 of the averaging sensor. The calculated liquid level is in reference to the lower end of the sensing section 48 of the averaging sensor 42 which is submerged in the $CO_2$ liquid.

To display the detected liquid level, the controller 50 preferably has on its control panel 51 a display device 70 which in a preferred embodiment is an LED display. The controller 50 includes a driver circuit 72 to drive the LED display 70 to display the calculated liquid level for viewing by the operator of the dry-cleaning apparatus.

From the forgoing, it can be appreciated that the invention provides a liquid level detection apparatus and method that can be advantageously used in a sealed and pressurized liquid storage tank to provide a continuous reading of the liquid level in the tank. The detection requires only three sensors: an averaging sensor disposed in both gas and liquid to provide an average signal, a first reference sensor disposed in the gas, and a second reference sensor disposed in the liquid. The liquid level can be conveniently derived from the signals of the three sensors by using, for example, a linear interpolation.

What is claimed is:

1. A liquid carbon dioxide dry cleaning apparatus comprising:

a cleaning vessel;

a storage tank sealed and pressurized for storing a liquid carbon dioxide dry cleaning fluid, said storage tank being connected to the cleaning vessel for providing the liquid dry cleaning fluid to the cleaning vessel during a cleaning operation;

a liquid level detection apparatus for monitoring a level of the liquid dry cleaning fluid in said storage tank, said liquid level detection apparatus including a plurality of sensors disposed in the pressure vessel for providing reference signals determined by a heat dissipation rate of a gas within the vessel above the liquid cleaning fluid and a heat dissipation rate of the liquid dry cleaning fluid within the vessel, and an average signal based upon a combination of the heat dissipation rates of both the gas and liquid dry cleaning fluid within the vessel; and a controller coupled to said sensors for receiving said average signal and reference signals for continuously determining the level of the liquid cleaning fluid in the vessel from said signals.

2. A liquid carbon dioxide dry cleaning apparatus as in claim 1 wherein said sensors comprise first, second, and third sensors each having a respective sensing section disposed within said vessel, said first sensor providing a reference signal determined by the heat dissipation rate of the gas, said second sensor providing a reference signal determined by the heat dissipation rates of the liquid, and said third sensor providing said average signal.

3. A liquid carbon dioxide dry cleaning apparatus as in claim 2 in which the sensing element of said first sensor is disposed above the level of liquid dry cleaning fluid in said pressure vessel; the sensing section of said second sensor is disposed entirely within liquid dry cleaning fluid within said pressure vessel; and the sensing section of said third sensor is disposed in part in said liquid dry cleaning fluid and in part above the level of the liquid dry cleaning fluid.

4. A dry-cleaning apparatus comprising:

a cleaning vessel;

a storage tank sealed and pressurized for storing a dry-cleaning fluid in a liquid form, said storage tank being connected to the cleaning vessel for providing the dry-cleaning fluid to the cleaning vessel during a cleaning operation;

a liquid level detector for monitoring a liquid level of the dry-cleaning fluid in the storage tank, including a first resistance temperature detector disposed above the dry-cleaning fluid in the storage tank and heated for providing a first signal indicating a resistance value of the first resistance temperature detector, a second resistance temperature detector submerged in the dry-cleaning fluid in the storage tank and heated for providing a second signal indicating a resistance value of the second resistance temperature detector, and a third resistance temperature detector extending in part above the dry-cleaning fluid and in part in the dry-cleaning fluid in the storage tank and heated for providing a third signal indicating a resistance value of the third resistance temperature detector; and a controller for receiving the first, second, and third signals and deriving a liquid level in the storage tank from the first, second, and third signals.

5. A dry-cleaning apparatus as in claim 4, wherein the dry-cleaning fluid is liquid carbon dioxide ($CO_2$).

6. A dry-cleaning apparatus as in claim 4, further including a constant current source for each of the first, second, and third resistance temperature detectors for passing a constant current through each of said detectors for heating thereof.

7. A dry-cleaning apparatus as in claim 4, further including a display device for displaying the liquid level determined by the controller.

* * * * *